US005171945A

United States Patent [19]

Su

[11] Patent Number: 5,171,945

[45] Date of Patent: Dec. 15, 1992

[54] CONTACT SWITCH

[75] Inventor: Su Su, Hsintien, Taiwan

[73] Assignee: Shin Juich Corp., Taiwan

[21] Appl. No.: 890,398

[22] Filed: May 26, 1992

Related U.S. Application Data

[63] Continuation of Ser. No. 638,120, Jan. 7, 1991, abandoned.

[51] Int. Cl.[5] ..... H01H 21/00; H01H 21/04

[52] U.S. Cl. ..... 200/6 R; 200/467

[58] Field of Search ..... 200/6 R, 6 B, 402, 408, 200/409, 463, 464, 465, 466, 467

[56] References Cited

U.S. PATENT DOCUMENTS 4,673,778 6/1987 Lewandowski et al. ..... 200/467

*Primary Examiner*—Harold Broome

*Attorney, Agent, or Firm*—Kinney and Lange

[57] ABSTRACT

A contact switch includes a casing, and a first, a second, and a third conductor mounted to the casing. Each of the first, second and third conductors has a leg portion extending downward and out of the casing. A spring mounting plate member extends from the leg portion of the first conductor inside the casing and has an upward end flange extending from one end of the mounting plate member. The mounting plate member has an opening and a top end portion provided with a gap to access the opening. A spring engaging member projects upward from the mounting plate member and is spaced from the end flange. The spring engaging member is provided with a pair of oppositely disposed notches. A movable contact arm has one end abutting the end flange and is turnable about the point of contact between the movable contact arm and the end flange. A helical spring member has a curved end attached to the spring engaging member at the notches thereof. The spring member has a second end provided with a rod portion that passes through the opening of the end flange and a hook portion extending from the rod portion and engaging the movable contact arm. The intermediate portion of the helical spring member is pressed to move the contact arm upward to break contact with the third conductor and to make contact with the second conductor.

11 Claims, 3 Drawing Sheets

CONTACT SWITCH

This is a continuation of application Ser. No. 07/638,120 filed on Jan. 7, 1991, abandoned as of the date of this application.

BACKGROUND OF THE INVENTION

1. Field of the Invention

The invention relates to a contact switch, more particularly to a microswitch, the assembly of which can be fully automated.

2. Description of the Related Art

Microswitches, or switches in which contact is made or broken by a slight motion, are widely known in the art. An example of such a switch is shown in FIGS. 1 and 2 to comprise a switch casing (a); conductors (b), (e1) and (e2); a movable contact arm (c); a spring member (d); a button member (f); and a lever (g). The conductors (b), (e1) and (e2) are mounted to the casing (a) and have downwardly extending leg portions projecting out of the casing (a). A spring mounting plate member (b7) extends from the leg portion of the conductor (b) inside the casing (a). An upward end flange (b4) extends from one end of the mounting plate member (b7) and is provided with an opening (b5). A spring engaging plate (b1) projects upward from the mounting plate member (b7) and is spaced from the end flange (b4). The spring engaging plate (b1) has a top end portion formed with a notch (b2), and a mounting hole (b3). The rear side of the end flange (b4) is provided with a pair of transversely extending guide grooves (b6) provided on opposite sides of the opening (b5). The movable contact arm (c) has a pair of spaced leg portions (c11) abutting and turnable about the guide grooves (b6) of the end flange (b4). The movable contact arm (c) has an engaging opening (c3). One end (d1) of the spring member (d) is hooked to the spring engaging plate (b1) at the notch (b2) and at the mounting hole (b3). The other end (d2) of the spring member (d) passes through the opening (b5) and is hooked to the movable contact arm (c) at the engaging opening (c3). The conductors (e1) and (e2) have contact portions disposed inside the casing (a) and extending respectively above and below the movable contact arm (c). The button member (f) is in contact with the intermediate portion of the spring member (d). The lever (g) is actuated to push the button member (f) downward to correspondingly actuate the spring member (d) to move the movable contact arm (c) upward from a first position, wherein the movable contact arm (c) is in contact with conductor (e2), to a second position, wherein the movable contact arm (c) is in contact with conductor (e1).

The main disadvantage of the above described microswitch lies in the assembly of the spring member (d) with the spring engaging plate (b1) and the movable contact arm (c). Most of the components of the microswitch can be machine assembled, with the exception of the spring member (d). As discussed earlier, the end (d1) of the spring member (d) is first hooked to the spring engaging plate (b1) at the notch (b2) and at the mounting hole (b3). The other end (d2) of the spring member (d) is then maneuvered through the opening (b5) and is hooked to the movable contact arm (c) at the engaging opening (c3). This procedure cannot be achieved by machines and must therefore be done manually. Because of the small size of the components, manually assembling the spring member (d) is difficult and takes up a lot of time. Production is thus low while labor costs are relatively high.

SUMMARY OF THE INVENTION

Therefore, the main objective of the present invention is to provide a contact switch, the assembly of which can be fully automated to increase production and reduce labor costs.

Accordingly, the preferred embodiment of a contact switch of the present invention comprises a casing, and a first, a second, and a third conductor mounted to the casing. Each of the first, second and third conductors has a leg portion extending downward and out of the casing. A spring mounting plate member extends from the leg portion of the first conductor inside the casing and has an upward end flange extending from one end of the mounting plate member. The mounting plate member has an opening and a top end portion provided with a gap to access the opening. A spring engaging member projects upward from the mounting plate member and is spaced from the end flange. The spring engaging member is provided with a pair of oppositely disposed notches. A movable contact arm has one end abutting the end flange and is turnable about the point of contact between the movable contact arm and the end flange. A helical spring member has a curved end attached to the spring engaging member at the notches thereof. The spring member has a second end provided with a rod portion that passes through the opening of the end flange and a hook portion extending from the rod portion and engaging the movable contact arm. The second conductor has a first fixed contact disposed above the movable contact arm, while the third conductor has a second fixed contact disposed below the movable contact arm. The contact switch further comprises means for pressing the intermediate portion of the helical spring member to move the contact arm upward from a first position, wherein the movable contact arm is in contact with the second fixed contact, to a second position, wherein the movable contact arm is in contact with the first fixed contact.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 3:
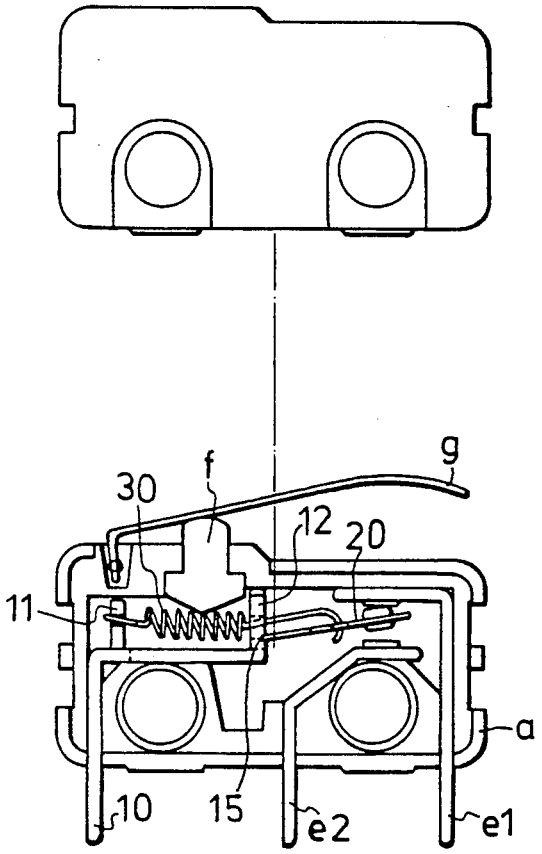
FIG. 3 is an illustration of the preferred embodiment of a microswitch according to the present invention.

Referring to FIG. 3, the preferred embodiment of a contact switch according to the present invention is shown to comprise a casing (a); conductors 10, (e1) and (e2) disposed inside the casing (a) and having downwardly extending leg portions projecting out of the casing (a); a movable contact arm 20; a helical spring member 30; a button member (f); and a lever (g).

Figure 4:
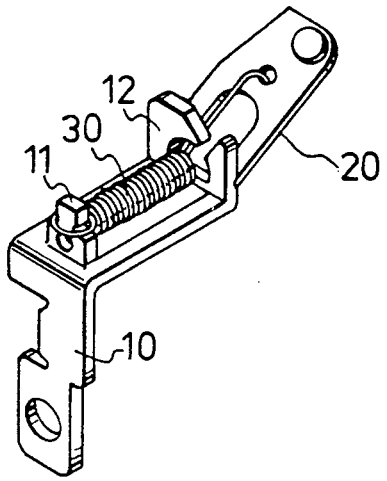
FIG. 4 is a perspective view of a portion of the microswitch of the present invention to illustrate its assembly.
Figure 5:
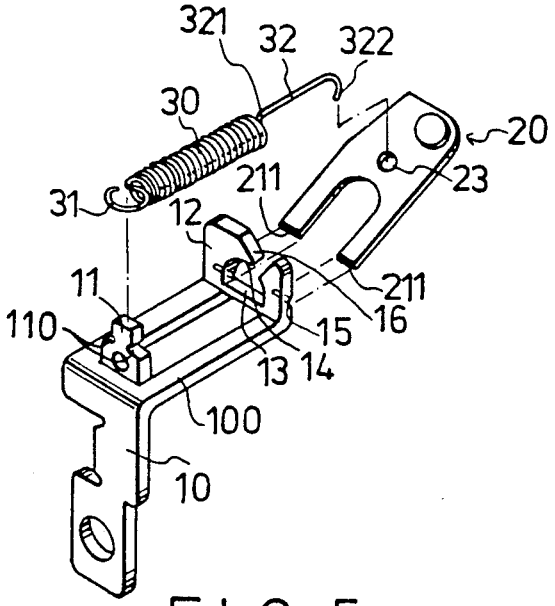
FIG. 5 is an exploded view of the microswitch portion shown in FIG. 4.

Referring to FIGS. 4 and 5, a spring mounting plate member 100 extends from the leg portion of the conductor 10 inside the casing (a). An upward end flange 12 extends from one end of the mounting plate member 100 and is provided with an opening 13. A spring engaging member 11 projects upward from the mounting plate member 100 and is spaced from the end flange 12. The spring engaging member 11 has a pair of oppositely disposed notches 110. The end flange 12 has a top end portion 14 provided with a gap 16 to access the opening 13. The rear side of the end flange 12 is provided with a pair of transversely extending guide grooves 15 on opposite sides of the opening 13. The movable contact arm 20 has a pair of spaced leg portions 211 abutting and turnable about the guide grooves 15 of the end flange 12. The movable contact arm 20 has an engaging opening 23. The spring member 30 has a curved end 31 hooked to the spring engaging member 11 at the notches 110. The other end 32 of the spring member 30 has a rod portion 321 extending through the opening 13 and a hook portion 322 extending from the rod portion 321 and engaging the movable contact arm 20 at the engaging opening 23 to adjustably mount the movable contact arm 20 on the end flange 12.

Figure 1:
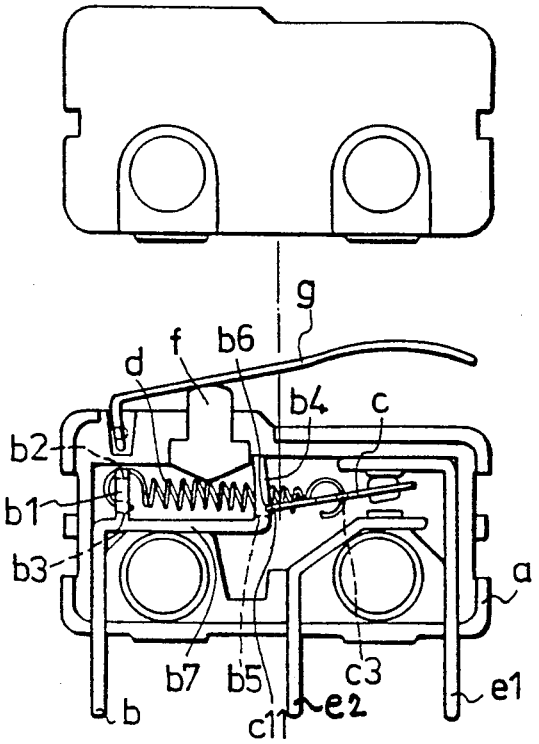
PRIOR ART FIG. 1
FIG. 1 is an illustration of a conventional microswitch.
Figure 2:
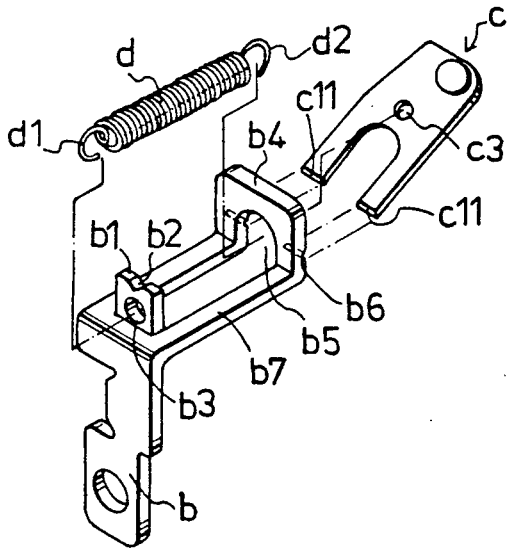
PRIOR ART FIG. 2
FIG. 2 is a perspective view of a portion of the conventional microswitch shown in FIG. 1.

It is thus shown that the contact arm of the contact switch of the present invention is easier to assemble than the microswitch shown in FIG. 1. The assembly of the contact switch can be fully automated since the engagement between the spring member 30 and the spring engaging member 11 and the insertion of the end 32 of the spring member 30 into the engaging opening 23 of the movable contact arm 20 can be easily accomplished by machines.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A contact switch comprising:

a casing;

a first conductor being mounted inside said casing, said first conductor comprising a spring mounting plate and a first leg, said first leg being connected to said spring mounting plate and extending generally downwardly therefrom and extending out of said casing;

an upwardly extending end flange being mounted to said spring mounting plate adjacent a first end thereof, said end flange having an upwardly directed gap and an opening, said gap providing access to said opening through said end flange;

a spring engagement member being connected to said spring mounting plate, said spring engaging member including an upwardly extending post and being spaced from said end flange;

a movable contact arm having a spring engagement hole therethrough, said movable contact arm abutting said end flange, and said movable contact arm being movable about the contact between said movable contact arm and said end flange;

a helical coil for movably connecting the contact arm relative to the first conductor, said helical coil comprising a curved end, a coil portion, a rod portion, and a hooked end, said upwardly extending post of the spring engagement member and the curved end being sized so that the curved end of the helical coil loops around the post of the spring engagement member to hitch the curved end of the helical coil to the spring mounting plate, the post of the spring engagement member extending through a loop of the curved end, said curved end being connected to a first end said coil portion, a second end of said coil portion being connected to a first end of said rod portion, a second end of said rod portion being connected to said hooked end, and said hooked end being attached to said movable contact arm through said spring engagement hole, said upwardly extending gap in said end flange being sized to receive the rod portion therethrough for placement in the opening of the end flange such that said helical coil extends through said opening in said end flange;

a second conductor comprising a first contact and a second downwardly extending leg, said first contact being disposed adjacent the movable arm, said first contact being connected to said second downwardly extending leg, and said second leg extending out of the said casing;

a third conductor comprising a second contact and a third downwardly extending leg, said second contact being disposed adjacent said movable arm such that said movable contact arm is disposed between said first contact and said second contact, said second contact being connected to said third leg, and said third downwardly extending leg extending out of said casing; and means for moving the helical coil from a first position of holding said movable contact arm in contact with said first contact to a second position of holding said movable contact arm in contact with second contact, said means for moving also being capable of moving said helical coil from said second position to said first position.

2. Said contact switch of claim 1 wherein said spring engagement member has a pair of oppositely disposed notches for receiving said curved end of said helical coil.

3. Said contact switch of claim 1 wherein said curved end of said helical coil defines a curved end plane, said curved end plane being disposed relatively parallel to a major plane of said spring mounting plate, when said curved end of said helical coil is secure to said spring engagement member.

4. Said contact switch of claim 1 wherein said curved end of said helical coil defines a curved end plane and said hooked end of said helical coil defines a hooked end plane, wherein said curved end plane is disposed generally perpendicular to said hooked end plane.

5. A contact switch comprising:

a casing;

a first conductor being mounted inside said casing, said first conductor comprising a spring mounting plate and a first leg, said first leg being connected to said spring mounting plate and extending generally downwardly therefrom out of said casing;

a movable contact arm having a spring engagement hole therethrough, said movable contact arm being pivotally supported relative to said first conductor for movement between a first contact position and a second contact position;

a helical coil for pivotally connecting the movable contact arm relative to the first conductor, said helical coil comprising a curved end, a coil portion, a rod portion, and a hooked end;

a spring engagement member including a generally upwardly extending post mounted to said spring mounting plate, said post being sized so that the curved end of the helical coil loops around the post to hitch the curved end of the helical coil to the spring mounting plate;

an upwardly extending end flange mounted to said spring mounting plate between said spring engagement member and said movable contact arm, said end flange having a upwardly extending gap in a top portion thereof and an opening, said upwardly extending gap providing access to said opening for placement of the rod portion of the helical coil therethrough so that said helical coil extends through said opening for placement of said hooked end into said spring engagement hole of said movable contact arm;

a second conductor comprising a first contact and a downwardly extending second leg, said first contact being disposed adjacent to the movable contact arm, said first contact being connected to said second leg, and said second leg extending out of said casing;

a third conductor comprising a second contact and a downwardly extending third leg, said second contact being disposed adjacent to said movable contact arm such that said movable contact arm is disposed between said first contact and said second contact, said second contact being connected to said third leg, and said third leg extending out of said casing; and means for moving the helical coil form a first position of holding said movable contact arm in contact with said first contact to a second position of holding said movable contact arm in contact with second contact, said means for moving also being capable of moving said helical coil from said second position to said first position.

6. Said contact switch of claim 5 wherein said post of said spring engagement member includes a pair of oppositely disposed notches for engaging said curved end of said helical coil.

7. Said contact switch of claim 5 wherein said movable contact arm includes a pair of space leg portions and said end flange includes a pair of transversely extending guide grooves, the guide grooves being sized to receive the leg portion of said contact arm for pivotally supporting the contact arm relative to the first conductor.

8. Said contact switch of claim 5 wherein the means for moving the helical coil includes:

a button member slidably mounted relative to said casing in align with said helical coil for alternatively engaging said helical coil for pivoting the contact arm between the first position and the second position; and a lever operably connected with said button member for alternatively moving said button member to engage and disengage said helical coil.

9. Said contact switch of claim 5 wherein said curved end of said helical coil forms a nearly closed loop.

10. Said contact switch of claim 5 wherein said curved end of said helical coil defines a curved end plane, said curved end of said helical coil being secured to said spring engagement member such that said curved end rotates about an axis lying within said curved end plane when said helical coil is moved between said first position and said second position.

11. A method of assembling a contact switch comprising:

providing a contact switch assembly comprising a movable contact arm pivotally connected to a conductor having a spring mounting plate to alternately move between a first contact position and second contact position;

providing a helical coil for pivotally securing said movable contact arm relative to the conductor, said helical coil including a curved end, a coil portion, a rod portion and a hooked end;

providing a spring engagement member including an upwardly extending post mounted to said spring mounting plate for securing the curved end of the helical coil relative to the conductor;

providing a spring engagement hole through said contact arm to receive the hooked end of the helical coil to secure the movable contact arm;

providing an upwardly extending end flange mounted to the spring mounting plate between the spring engagement member and the contact arm for securing the hooked end of the helical coil relative to the conductor, said end flange having an opening and an upwardly extending gap for placement in said opening;

lowering the curved end of the helical coil toward the upwardly extending post of the spring engagement member to loop the curved end therearound to hitch the helical coil to the spring mounting plate;

lowering the hooked end of the helical coil toward the contact arm to hook the hooked end through the spring engagement hole of the contact arm; and lowering the rod portion of the helical coil toward the upwardly extending end flange through the upwardly extending gap into the opening.

* * * * *

UNITED STATES PATENT AND TRADEMARK OFFICE

CERTIFICATE OF CORRECTION

PATENT NO. : 5,171,945

DATED : December 15, 1992

INVENTOR(S) : SU SU

It is certified that error appears in the above-identified patent and that said Letters Patent is hereby corrected as shown below:

Col. 5, line 34, delete "form", insert "from"

Signed and Sealed this

Ninth Day of November, 1993

Bruce Lehman

*Attest:*

BRUCE LEHMAN

*Attesting Officer*

*Commissioner of Patents and Trademarks*